US008280297B2

(12) United States Patent
No et al.

(10) Patent No.: US 8,280,297 B2
(45) Date of Patent: Oct. 2, 2012

(54) ELECTOPHOTOGRAPHIC BORDERLESS PRINTING METHOD AND APPARATUS

(75) Inventors: Young No, Pittsford, NY (US); Joseph A. Manico, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 389 days.

(21) Appl. No.: 12/339,693

(22) Filed: Dec. 19, 2008

(65) Prior Publication Data

US 2010/0158546 A1 Jun. 24, 2010

(51) Int. Cl.
*G03G 15/00* (2006.01)

(52) U.S. Cl. ..... 399/400; 399/45

(58) Field of Classification Search ..... 399/38, 399/400

See application file for complete search history.

(56) References Cited

U.S. PATENT DOCUMENTS

| | | | | |
|---|---|---|---|---|
| 4,373,239 | A | 2/1983 | Henry et al. | |
| 4,377,333 | A * | 3/1983 | Tsuji et al. | 399/18 |
| 4,689,471 | A | 8/1987 | Pirwitz et al. | |
| 5,204,716 | A | 4/1993 | Kasahara et al. | |
| 5,234,782 | A | 8/1993 | Aslam et al. | |
| 6,026,276 | A * | 2/2000 | Malachowski | 399/400 |
| 6,087,641 | A | 7/2000 | Kinouchi et al. | |
| 6,991,327 | B2 * | 1/2006 | Goto et al. | 347/96 |
| 7,095,526 | B1 | 8/2006 | Housel | |
| 7,154,518 | B2 * | 12/2006 | Kim | 347/185 |
| 8,107,843 | B2 * | 1/2012 | Law | 399/69 |
| 2002/0146254 | A1 | 10/2002 | Richtsmeier | |
| 2003/0039491 | A1 | 2/2003 | Bogoshian | |
| 2003/0049042 | A1 | 3/2003 | Bogoshian | |
| 2003/0133731 | A1 * | 7/2003 | Nakazawa et al. | 399/384 |
| 2005/0099644 | A1 | 5/2005 | Nomoto et al. | |
| 2005/0169650 | A1 | 8/2005 | Ito et al. | |
| 2006/0216047 | A1 * | 9/2006 | Yamamoto et al. | 399/45 |
| 2007/0002095 | A1 * | 1/2007 | Ozawa et al. | 347/37 |
| 2007/0019220 | A1 * | 1/2007 | Miyazaki et al. | 358/1.12 |
| 2007/0059058 | A1 | 3/2007 | Ito et al. | |
| 2007/0153310 | A1 * | 7/2007 | Jung | 358/1.12 |

FOREIGN PATENT DOCUMENTS

| | | | |
|---|---|---|---|
| EP | 0 373 654 | A2 | 6/1990 |
| JP | 9 160408 | A | 6/1997 |
| JP | 09160408 | A | 6/1997 |
| JP | 2008 165153 | A | 7/2008 |

* cited by examiner

*Primary Examiner* — Anthony Nguyen
(74) *Attorney, Agent, or Firm* — Kathleen N. Manne

(57) ABSTRACT

A method and apparatus for determining whether borderless printing can be done based on media type and desired gloss level is provided. Also provided is a method, printer, and system whereby a defect-free borderless print can be achieved regardless of media type and gloss level of the finished print, wherein the method includes pre-heating of the leading edge of the media before it enters a fuser area of the printer.

13 Claims, 2 Drawing Sheets

ELECTOPHOTOGRAPHIC BORDERLESS PRINTING METHOD AND APPARATUS

CROSS REFERENCE TO RELATED APPLICATIONS

This application is related to subject matter found in co-filed U.S. application Ser. No. 12/339,658, filed on Dec. 19, 2008.

FIELD OF THE INVENTION

The invention relates to a method of determining if borderless printing is possible on a given media-type, and printing the borderless medium.

BACKGROUND OF THE INVENTION

Printing methods have evolved to allow both monochromatic and full color printing in many mediums, including ink jet, laser printing, and electophotographic printing using toners. With the development of printing colors, particularly more photo-realistic colors, and improvements in the sharpness of the print quality, more photographic images are being printed by these techniques.

In particular, electophotographic printing is popular for printing text and images. This remains a very cost effective method of printing. Further, electophotographic printers exist which are capable of handling media of many different sizes, finishes, and compositions. This enables printing of various sizes of text documents, mixed text and images, and images, in various formats. Electophotographic printing can produce text documents, images, calendars, mixed format presentation layouts, advertising copy, flyers, brochures, greeting cards, photo albums, montages, and collages, including simplex and duplex prints, for example. With the advancements in printing technologies, more prints that are borderless are desired, particularly photographic or mixed image and text prints. In addition producing these types of prints also can require various finishes, such as gloss, matte, or textured finishes. However, borderless printing of electophotographic prints is difficult.

U.S. Pat. No. 7,095,526 to Housel, issued Aug. 22, 2006, discusses methods of determining layouts for full-bleed printing, to result in borderless prints. Housel teaches placing an image on the medium to minimize post-print trimming. Housel presumes at least one edge of the printed medium will still require trimming. Because Housel does not fully eliminate trimming, he does not produce a borderless print. The method of Housel introduces an additional production step, requiring an operator to setup a post-printing trimming device and trim the printed output to desired dimensions of the final product, increasing labor costs and production time, introducing the possibility of operator error, wasting material, and requiring additional equipment, such as the trimming device.

Housel discusses that though certain high-end printers and copiers can be enabled to print "full bleed," that is, to the very edge of the medium, but teaches that, because of quality concerns, many electophotographic printers do not allow full bleed printing. The quality issues are image defects that result from the interaction of the leading edge with the nip or fuser rollers, which can cause marking, smearing, or other undesirable results on the leading edge.

U.S. Pat. No. 5,234,782 to Aslam et al., issued Aug. 10, 1993, provides further information on the problems of electophotographic leading edge image defects. As described in Aslam et al., and known in the art, in electophotographic printing, a medium having toner on it is fed into a nip of a pair of moving pressure members, typically heated rollers, which are urged together with enough force to create substantial pressures on the printed medium in the nip, for example, pressures up to 100 pounds per square inch and higher. This often results in an image defect in the leading one-eighth of an inch of the resulting printed image. In particular, the leading edge has a tendency to offset onto the heated roller contacting it, leaving a visible mark on the final print and requiring cleaning of the heated roller. Aslam et al. solve the problem by not coating the thermoplastic layer used to retain toner all the way to the leading edge of the medium, and either having the leading edge be a white border, or trimming the leading edge to form a borderless print.

Aslam et al. teaches use of a preheating device to preheat the printed medium on the side opposite the toner before the printed medium enters the heated rollers, also called fuser rollers. The preheating device elevates the temperature of a thermoplastic layer on the toner side of the medium to slightly above its glass transition temperature so that the toner can be embedded in the thermoplastic layer. Aslam et al. notes that this process results in an image defect at the leading edge of the print, in particular, a substantial mark in the first one millimeter of the final image, caused by offset of the leading edge onto the heated rollers.

Aslam et al. fully describe three phenomena that may cause the leading edge defect, even with preheating. First, if the heated roller contacting the medium is slightly overheated, it will cool somewhat upon contact with the medium, but result in a heat transfer such that the leading edge of the medium will be overheated, melting the thermoplastic layer. Second, when the medium is engaged in the nip, the roller drivers must overcome the initial inertia associated with driving the medium. The rollers momentarily slow down, thus maintaining contact with the leading edge of the medium for a longer period of time than they engage any other area of the medium, causing the leading edge to overheat. Third, the thickness of the medium causes the top corner edge of the medium to engage one of the rollers at a position slightly upstream of the point of contact between the two rollers, or nip. As the medium advances, it spreads the rollers apart, but the leading edge continues to contact the first roller until it reaches and passes through the nip, resulting in overheating of the leading edge of the medium. The rest of the medium only contacts either roller at the nip, thus having a shorter exposure to the heat of the roller.

Heating of the medium before fusing to prevent offset is also discussed in U.S. Pat. No. 5,112,717 to Baxter et al., as a means of softening the thermoplastic layer to impart a gloss or texture to the printed surface.

As noted in U.S. Pat. No. 5,234,782 to Aslam et al., and as generally known in the industry, such preheating does not prevent leading edge defects in electophotographic prints. Again, reference is made to U.S. Pat. No. 7,095,526 to Housel, discussed above, wherein the leading edge is either not printed or trimmed.

It is desirable to have a method of providing full-bleed, or borderless, printing using an electophotographic printer, wherein the resulting print is free of image defects. The ability to print borderless images reduces waste by eliminating the need to trim an image, which requires additional time and resources, and wastes media.

SUMMARY OF THE INVENTION

The invention relates to a method of forming electophotographic borderless prints. The method includes inserting media into a printer, determining the media type, providing print data to the printer, and determining, based on the media type, print data, or both, if borderless printing is possible. Where borderless printing on the specified media type is possible, the leading edge of the media is pre-heated before entering a fusing area of the printer. A printer and system for forming electophotographic borderless prints are also described.

ADVANTAGES

The invention provides a means of determining if borderless printing is possible based on the type of media to be printed. If borderless printing is possible, it enables such printing without image defects, and without waste of resources, including time, labor, and materials, because a full-bleed print is produced. If borderless printing would likely produce an image defect, a pre-heater is engaged to enable borderless printing, reducing waste.

DETAILED DESCRIPTION OF THE INVENTION

The invention relates to apparatus and methods for production of electophotographic printed images on media. For the sake of clarity, the four edges of the media may be referred to herein as the leading edge, the trailing edge, and two lateral edges, in reference to the direction of travel through the printer. The printed output is referred to in terms of a print area, defined by a length and width of the finished printed product.

Figure 1:
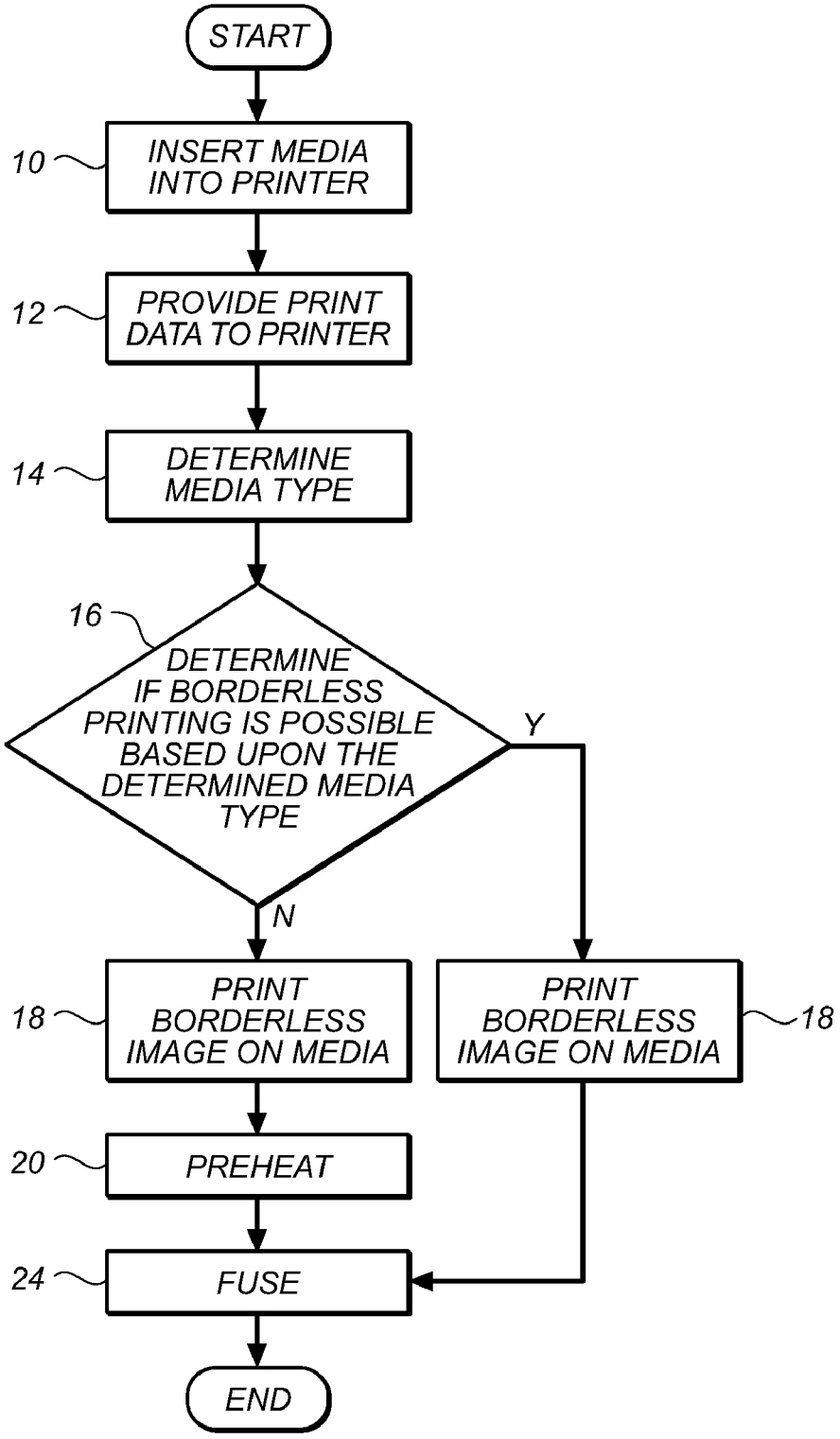
FIG. 1 shows a first embodiment of a method.
Figure 2:
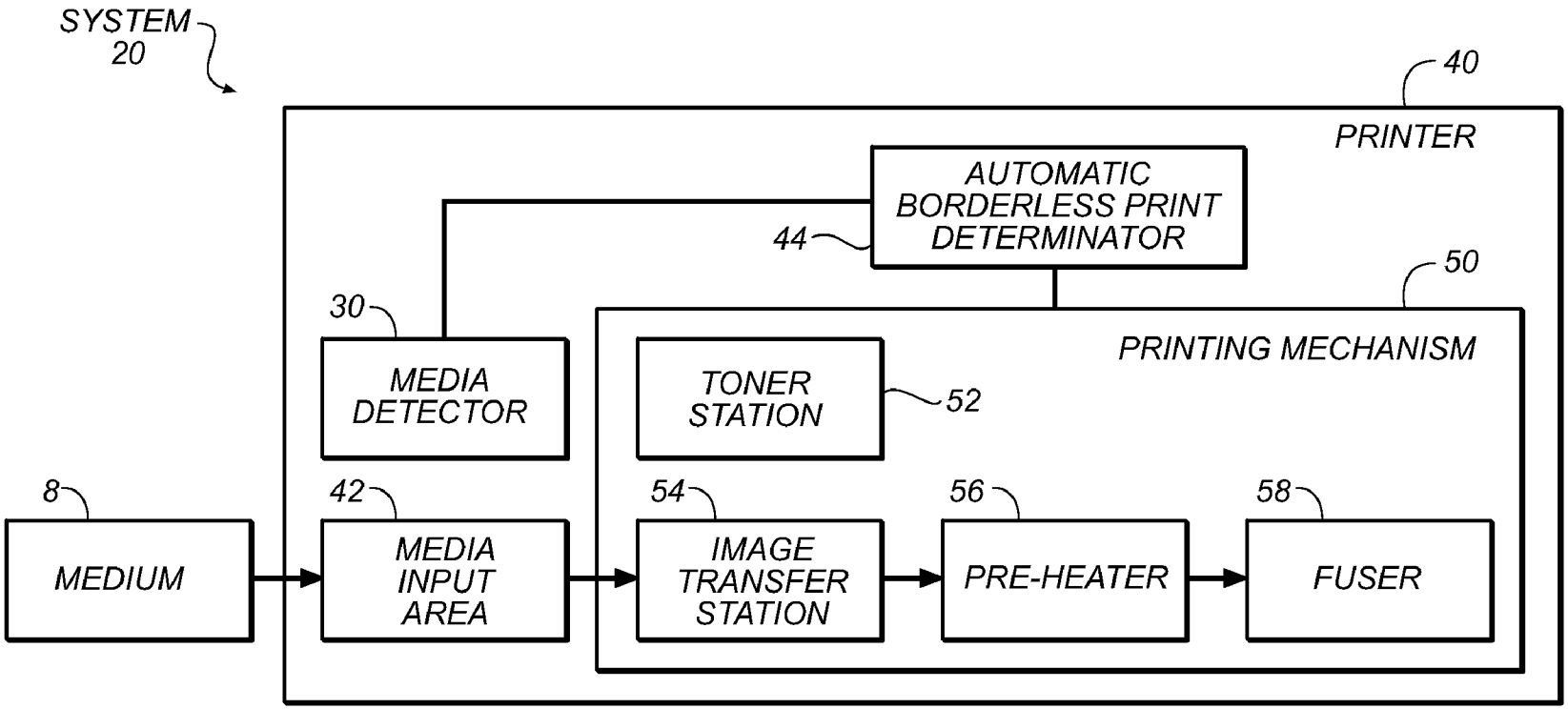
FIG. 2 shows a first embodiment of a printer and printing system.

As in shown in FIG. 1, a method of forming electophotographic borderless prints includes inserting media 8 into a printer such as printer 40 shown in FIG. 2 (Step 10); providing print data to the printer (Step 12); determining the media type (Step 14); and determining if borderless printing is possible based on the determined media type (Step 16). Where borderless printing would typically cause a leading edge image defect, the printer pre-heats a leading edge of the media before the media enters a fusing area in the printer to enable defect-free borderless printing.

In general, electophotographic printing (Step 18) can occur in a number of ways, including direct and indirect image transfer of a toner image to a medium, also referred to as a receiver or receiving sheet. Typically, in an electophotographic printer, a photoconductive drum is uniformly charged at a charging station. The photoconductive drum is image-wise exposed by a laser, an LED, or any other optical exposure device located at an exposure station. The charged photoconductive drum then accepts toner image-wise from one or more toner stations 52 by electrostatic attraction. If more than one color toner is used, consecutive images are formed, one with each color, and are transferred in registry to the surface of a receiver at a transfer station 54. The receiver is typically attached to a transfer roller or belt, and is brought into transfer relation with the toner-coated photoconductive drum to form a toner image on the receiver, this being repeated until all desired toner colors are transferred.

A multicolor image can also be formed using an intermediate drum or web between the photoconductive drum and the receiver. In this case, two or more color toners are transferred in registry to the intermediate drum or web, and the registered colors are transferred from the intermediate drum or web as a single multicolor image to the receiver. Alternately, the receiver can receive a multicolor image directly from the photoconductive drum in a single transfer, where the multicolor image is formed on the photoconductive drum by known processes wherein two or more exposures and corresponding color images are formed directly on the photoconductive drum.

Because toner particles are typically very small and dry, regardless of whether they are chemically prepared or ground, transfer of the particles at the transfer station from the photoconductive drum to the receiver or intermediate drum or web can be aided by heating both the toner and the receiver. The receiver can be a substrate, for example paper, coated with a thermoplastic material capable of accepting the toner particles. The thermoplastic material of the receiver and the toner can be heated to cause preferential adherence of the toner to the receiver as compared to adherence between the toner and the photoconductive drum. Heating of the receiver can be indirect, such as by heating the transfer roller or belt on which the receiver is placed, or the receiver can be heated by radiant heat. Heating of the thermoplastic layer on the receiver to its glass transition temperature facilitates at least partial embedding of the toner into the thermoplastic layer.

Once the receiver has been coated with one or more toner, the receiver is passed to a fusing area (Step 24). The fusing area can be two or more rollers, webs, shoes, a single roller and stationary surface, or some combination thereof, between which the receiver passes. The fusing station applies pressure and heat to the toner-coated receiver to embed the toner in the thermoplastic layer on the receiver.

Depending on a desired level of gloss, a clear toner can be applied after the one or more colored toners. The clear toner can be fused to the thermoplastic layer of the medium with the other one or more toner colors. The clear toner can be applied to the full surface of the image, or as an inverse mask of the image, that is, applied to non-image space within the borders of the final print product dimensions. The clear coat forming a matte, semi-gloss, or gloss finish can be heated a second time to increase gloss levels, and can be embossed to form a special effect or desired matte or gloss level.

Electophotographic printers and systems as described above and as otherwise known in the art can be modified to achieve the invention, now described.

Borderless prints, also known as full-bleed prints, have been created from electophotographic systems, but only by trimming of the leading edge after printing. Thus, as printed, the electophotographic prints previously have not been truly borderless at printing, requiring modification to create a borderless product. Full-bleed printing has been done between the lateral edges, or on the trailing edge, of a medium, but not the leading edge due to the high potential for image defects, as discussed elsewhere herein.

The inventor has identified a key cause of leading edge image defects in borderless printing. Leading edge image defects, which result from overheating of the receiver as described elsewhere herein, are dependent on the beam strength of the receiver. If the receiver has a high beam strength, image defects can occur due to hot offset, where toner is removed from the receiver and left in the fusing area. If the receiver has a low beam strength, the receiver can adhere to the fuser roller, causing printer jams, burning of the receiver, or fire. This can be costly to repair.

A clear toner for forming a matte or gloss finish on a print can further effect whether a borderless print can be formed without an image defect. The addition of clear toner creates a thicker toner layer for fusing, and can create additional sticking to the equipment in the fuser area. Additionally, dependent on the surface area covered by the clear toner, the additional toner amounts can cause sticking on a leading edge of the medium. The clear toner can be applied in a thick coat, particularly where a high gloss level is required.

To prevent these problems, a printer or printing system can include a media detector, which determines the type of media placed in the printer, and a borderless print determinator, which determines whether the media is capable of sustaining borderless, full-bleed, edge-to-edge printing based on the media type alone or in combination with the print data received by the printer.

The media detector 30 can be a user input panel, wherein the user indicates the media type being used by entry of a code corresponding to the media type, or selection from a list of media. The media detector can be a visually discerning device capable of finding and interpreting a marking on the medium, for example, a bar code reader, UV detector, or scanner. The medium can have an indicator of media type in the form of human readable markings, a bar code, a UV ink mark, a watermark, or any other form of indicia. The media detector can be a measuring device, capable of determining the media thickness, beam strength, or stiffness of the media.

The thickness of the media can be determined by the printer based on measurement of the height of the media in a paper tray, divided by the number of sheets in the tray. The number of sheets in the tray can be a number entered by a user, or the printer can cycle through the paper to count the sheets, returning counted sheets to the same or a different paper tray.

The information gained by the media detector can be provided to a borderless print determinator to determine if the media is capable of sustaining borderless printing. In addition to the information on media type, if known, the desired gloss level of the final print product can be provided to the borderless print determinator. The gloss level can be provided as part of the print data, or can be selected by the user from a menu on the printer user interface. The borderless print determinator can include a look-up table, a logic table, or other format of pre-set conditions that enable determination of whether borderless printing can be done without an image defect. The borderless print determinator can be a logic circuit, computer chip, memory, computer processing unit, or other known apparatus or system for comparing data. Alternately, a look-up table or other guideline for media type could be provided to a user, who can then act as the borderless print determinator based on the information provided.

Other system attributes that can be determined by the printer, pre-programmed into the printer, or entered by the user, and which can be used by the borderless print determinator in deciding whether a borderless print can be made, can include printer specifications, toner specifications, media specifications, or ambient conditions. For example, printer specifications can include printer transport speed, fuser area nip width, fuser area nip exit angle, whether and what type of coating is on the fuser apparatus where it can contact the toner-bearing side of the media, compliance of the fuser apparatus on a side not adjacent to the toner on the media. Toner attributes can include melting point temperature and glass transition point temperature. Media attributes can include media composition, density, and moisture content. Ambient conditions can be determined by one or more printer sensor, entered by the user, or determined by remote apparatus and relayed to the printer, and can include relative humidity, temperature, and barometric pressure.

Determination of whether a borderless print will be successful (Step 16) can be done based on the beam strength of the media, weight of the media, the desired gloss level, or any one or more of the other system attributes, alone or in combination. To enable borderless printing, the media can have a beam strength or stiffness of about 600-800 mN or greater. Media suitable for borderless printing can have a weight of 250 gsm (grams per square meter) or higher, referred to herein as "heavy media." Typically, such heavy media does not experience image defects in borderless printing. If the media weight is less than 250 gsm ("light media"), there is a greater probability that borderless printing will create a defect in the first few millimeters of the print. Thus, light media, having a weight of less than 250 gsm, is not desirable for borderless printing. Adding a gloss finish, regardless of level, matte, semi-gloss, or high gloss, will cause a light media to stick to the apparatus in the fuser area, creating image defects. Any type of media with a toner load at or near the leading edge, whether from a clear coat, text, or image, can cause sticking in the fusing area due to the height of the applied toner.

Once it is determined if a defect-free borderless image could be printed based on media type, the printer or printing system can notify the user. The notification can be in the form of not providing borderless printing as a print option to the user where it is not advisable based on the media detection. The notification can be in the form of providing borderless printing as an option to the user where media detection supports such printing. The notification can be in the form of providing borderless printing as an option to the user with a warning of possible image defects. If the print data has already been provided to the printer, including the request for borderless printing, the printer can display a message that borderless printing is not available, or warn that image defects may occur. In the latter case, the printer can request verification the user wishes to proceed with a possibly defective image print.

As described so far herein, borderless printing in a typical printer should be disabled, or provide a warning, when the media is determined to meet certain conditions. However, the inventor has determined a method of printing such media to enable borderless printing.

Media can be pre-heated before entering the fuser area 58. The purpose of pre-heating is to raise the temperature of the media sufficiently such that the toners melt into the thermoplastic layer of the medium before the medium enters the fusing area. If the toner is adhered firmly to the medium, it will not stick to the fuser roller or web. Only the first few millimeters, corresponding to the length of the leading edge that first contacts the fusing area and therefore experiences extra heating time as compared to the remainder of the medium, needs to be preheated.

The pre-heater can be located on the toner side or substrate side of the medium. If located on the toner side of the medium, the pre-heater can be a radiant heater, for example but not limited to an infrared heat source, laser, or other non-contact heat source. If the pre-heater is located on the substrate side, it can be a contact or non-contact heater, though a non-contact heater would need to be of sufficient energy to heat the medium all the way through. Examples of suitable heater can include but are not limited to on-demand heaters and impulse heaters, which can include ceramic heaters, tungsten heaters, lasers, infrared heaters, NiChrome beaters, and other known heat sources. Preferably, the pre-heater is small, being able to be fitted into existing printers without requiring a different housing or interfering with the pre-existing mechanical configuration. The pre-heater can be inserted into a printer just before the fusing area. The pre-heater can be used with a simplex or duplex print. If a duplex print is to be borderless, the pre-heater can be a contact pre-heater on the side of the medium opposite the non-fused toner. The pre-heater should not contact non-fused toner.

The pre-heater 56 should be of sufficient heat-generating capacity to cause the toner to stick to the thermoplastic layer on the medium. Typically, this requires sufficient heat to tack or sinter the medium. The exact amount of heat required is dependent on the type of toner, each toner having a different melting point. The heat needed can be determined for a given printer based on the toner type, and a heat source corresponding to the required heat energy provided as the pre-heater.

In operation, once it is determined that borderless printing can not be performed without an image defect, the request for borderless printing can trigger operation of the pre-heater (Step 20). The pre-heater can be activated by entry of the media into the printer, or by pick-up of the media by a media picker. The pre-heater can be on a timing circuit such that it generates heat only for a time sufficient for the first few millimeters of media to pass by, coordinated with the printer mechanism speed. The pre-heater can be used such that it is turned off as the trailing edge of the media enters the printer or passes a media sensor at the paper input area of the printer. The pre-heater can be preceded immediately by, or have thereon, a pre-heater media sensor, either physical or optical, such that detection of the media by the sensor turns the pre-heater on, and the pre-heater shuts off after a predetermined time, after a certain amount of medium has passed through, or when the trailing edge passes either the paper input sensor or the pre-heater media sensor. The pre-heater can be left on all the time without harm to the media.

The invention has been described in detail with particular reference to certain preferred embodiments thereof; but it will be understood that variations and modifications can be effected within the spirit and scope of the invention.

The invention claimed is:

1. A method of forming electophotographic borderless prints in a printer, wherein the printer comprises:

a media input area;

a printing mechanism including a toner station, an image transfer station, a pre-heater, and a fusing area; and a media output area, and wherein the method comprises:

determining a media type of a medium in the media input area;

determining if borderless printing of an image based upon print data provided to the printer is possible using a medium of the determined media type;

image-wise providing toner on the medium according to the print data;

and pre-heating only a leading edge of the medium corresponding to the length of the leading edge that first contacts the fusing area with the pre-heater that heats the medium such that the toners melt into the thermoplastic layer of the medium before the medium enters the fusing area when it is determined that borderless printing of an image based upon the print data is not possible without a high risk of defects at the leading edge using the medium of the determined media type and otherwise allowing the leading edge of the medium to enter the fusing area without pre-heating the leading edge.

2. The method of claim 1, wherein the print data includes an instruction for borderless printing.

3. The method of claim 1, wherein the step of pre-heating further comprises turning on the pre-heater when the leading edge of the media is detected by a pre-heater media sensor and turning off the pre-heater after the leading edge has been pre-heated.

4. The method of claim 1, wherein the step of pre-heating further comprises turning on the pre-heater when the leading edge of the media is detected by a pre-heater media detector.

5. The method of claim 1, wherein the pre-heater is an on demand or impulse heater.

6. The method of claim 1, wherein the step of pre-heating further comprises adjusting at least one of a temperature and a duration of the pre-heating.

7. The method of claim 1, wherein the step of pre-heating further comprises turning off the pre-heater after detection of a trailing edge of the media by the pre-heater media sensor.

8. The method of claim 1, wherein the step of pre-heating further comprises turning off the pre-heater after detection of a trailing edge of the media by a pre-heater media detector.

9. A printer for forming electophotographic borderless prints, wherein the printer comprises:

a media input area;

a media detector that detects a media type of a medium in the media input area;

an automatic print determinator; and a printing mechanism including a toner station that forms toner in an image-wise fashion according to print data received by the printer, an image transfer station that transfers image-wise formed toner to the medium, a pre-heater that is positioned so that the pre-heater heats only a leading edge of the medium corresponding to the length of the leading edge that first contacts the fusing area before the leading edge of the medium reaches a fusing area when caused to do so by the automatic print determinator;

wherein the automatic print determinator causes the pre-heater to pre-heat the leading edge of the medium such that the toners melt into the thermoplastic layer of the medium before the medium enters the fusing area before the leading edge of the medium enters the fusing area when the automatic print deteminator determines that borderless printing of an image without a high risk of defects at the leading edge is not possible based upon the print data and based upon the detected media type of a medium on which the borderless print will be formed and otherwise allows the leading edge of the medium to enter the fusing area without pre-heating the leading edge.

10. The printer of claim 9, wherein the media detector comprises a user input area.

11. The printer of claim 10, wherein at least one of the print data, and the media type is entered through the user input area.

12. The printer of claim 11, wherein the at least one of the print data, and the media type is provided to the automatic borderless print determinator.

13. A system for forming electophotographic borderless prints, comprising:

a media detector having a user input panel at which at least a media type for a medium to be used in generating an image can be entered; and a printer, wherein the printer comprises:

a media input area;

an automatic print determinator; and a printing mechanism including a toner station that forms toner in an image-wise fashion according to print data received by the printer, an image transfer station that transfers the image-wise formed toner to the medium, a pre-heater that is positioned so that the pre-heater applies heat to a leading edge of the medium before the leading edge of the medium reaches a fusing area to raise the temperature of the media sufficiently such that the toners melt into the thermoplastic layer of the medium before the medium enters the fusing area when caused to do so by the automatic print determinator;

wherein the automatic print determinator causes the pre-heater to pre-heat a leading edge of the medium corresponding to the length of the leading edge that first contacts the fusing area while leaving other portions substantially unheated before the leading edge of the medium enters the fusing area when the automatic print deteminator determines that borderless printing of an image based upon the print data is not possible without a high risk of defects at the leading edge based upon the detected media type of a medium on which the borderless print will be formed and otherwise allows the leading edge of the medium to enter the fusing area without pre-heating the leading edge.

* * * * *